US005496110A

United States Patent [19]

Geier et al.

[11] Patent Number: 5,496,110

[45] Date of Patent: Mar. 5, 1996

[54] APPPARATUS FOR MIXING AND EXTRACTING SAMPLES

[76] Inventors: James W. Geier, 8495 Big Cedar Ct., Riverdale, Ga. 30274; Jeff E. Newman, 1055 Salisbury Trail, Riverdale, Ga. 30296

[21] Appl. No.: 222,682

[22] Filed: Apr. 4, 1994

[51] Int. Cl.[6] ..... B01F 9/10; B01F 15/02

[52] U.S. Cl. ..... 366/214; 366/220; 220/211; 220/203.01

[58] Field of Search ..... 366/139, 208, 366/209, 210, 211, 213, 214, 215, 605; 220/203, 206, 211; 422/99

[56] References Cited

U.S. PATENT DOCUMENTS

| | | | |
|---|---|---|---|
| 2,021,261 | 11/1935 | Moore | 366/214 |
| 2,284,991 | 6/1942 | Sewell | 366/214 |
| 3,623,705 | 11/1971 | Townsley . | |
| 3,735,962 | 5/1973 | Pagano . | |
| 3,735,964 | 5/1973 | Lorenzen . | |
| 4,030,322 | 6/1977 | Pettit | 220/211 |
| 4,097,026 | 6/1978 | Haindl . | |
| 4,109,319 | 8/1978 | Brandt . | |
| 4,173,418 | 11/1979 | Vork . | |
| 4,201,483 | 5/1980 | Franzke | 366/139 |
| 4,445,782 | 5/1984 | Sparrow, Jr. . | |
| 4,747,693 | 5/1988 | Kahl . | |
| 4,842,415 | 6/1989 | Cane et al. . | |
| 5,167,928 | 12/1992 | Kelly | 366/211 |

OTHER PUBLICATIONS

Glas–Col® Brochure, titled "Mixing Products," (undated).

*Primary Examiner*—Robert W. Jenkins

*Attorney, Agent, or Firm*—Dean W. Russell; Mitchell G. Stockwell; Kilpatrick & Cody

[57] ABSTRACT

An apparatus for mixing a plurality of vessels containing various sample and reagent materials is disclosed. The apparatus comprises mechanisms for holding the vessels and rotating the vessels about an axis. A valve for venting pressure is provided and is controlled by a solenoid that is actuated only when the vessels are in a generally upright position so that liquid or solid contents of the vessels will not escape through the pressure venting valve. Additionally a work station is provided that houses the apparatus of the present invention and allows the user to complete the mixing and extracting process without removing the vessels from the holding tray.

19 Claims, 5 Drawing Sheets

APPPARATUS FOR MIXING AND EXTRACTING SAMPLES

BACKGROUND OF THE INVENTION

This invention relates to the mixing and extracting of samples using an apparatus that includes means for holding and rotating a plurality of vessels. Additionally, the present invention provides pressure venting of the vessels when they reach a predetermined position by the use of solenoid-activated, spring-loaded actuator rods. A work station encloses the apparatus of the present invention and provides work and storage space. Accordingly, the present invention safely and efficiently batch processes multiple samples of various materials.

A common method for performing the mixing and extracting procedure in laboratories is to place a separatory funnel in a ring stand, add sample and reagents, remove the separatory funnel from the ring stand and shake by hand for several minutes. After replacing the separatory funnel in the ring stand, the sample and reagents are left to stand several minutes before extracting the bottom layer into another container and, if necessary, adding more reagents to repeat the procedure for as many times as required for the particular method being performed.

Some attempts have been made at automating at least portions of this process. For instance, U.S. Pat. No. 4,109,319 to Brandt reveals an agitator device that shakes automatically the contents of a vessel placed upon a table-like surface. Similarly, U.S. Pat. No. 4,747,693, to Kahl discloses a laboratory mixer that consists of a shaft that rotates in an eccentric manner to agitate the contents of vessels held by a vessel holder. In addition to disclosing means for restraining various test-tube-like vessels, the Kahl patent also provides for controlling both the time period during which the vessels are agitated and the amount of agitation.

SUMMARY OF THE INVENTION

In the field of mixing and extracting liquid samples, safely handling the numerous samples and reagents that may be necessary are key characteristics to consider in designing any automated apparatus for improving processing efficiency. The present invention incorporates both flexibility in the type and number of samples that may be processed and various safety features to provide automated batch processing of multiple samples. Economies of scale are thereby created and the number of man hours required to extract a given number of samples is significantly reduced, saving greatly on labor costs.

An apparatus is provided for holding a plurality of mixing vessels, which may be standard industry separatory funnels sold, for instance, by Corning under the trademark PYREX®. A variable-speed motor connected to a drive shaft via a chain and sprocket arrangement can be automatically controlled to revolve the holding tray about an axis to mix the contents of the vessels for a set time period or number of revolutions.

Stoppers with pressure venting valves are retained in place by a cover that rotates to close over the open ends of the vessels and is then latched shut. Between the cover and open vessel ends are assemblies containing solenoids that hold closed valves within the stoppers unless the vessels are in a generally upright position. Because each solenoid is individually secured so as to float within the cover, many types of mixing vessels can be used in the same run. Once actuated, the solenoid moves away from the valve so that internal pressure will force the valve open, allowing gases to vent upward while preventing sample material from escaping the vessels. Such pressure release is critical to prevent the bursting of vessels, for instance, where solvents react with samples to release gasses and thereby increase pressure. The present invention offers an automated mechanism for releasing that pressure, which may reduce the associated danger to laboratory personnel. Dangerous or troublesome gases can thereafter be vented away from workers, by, for example, a ventilation system.

An additional feature of the present invention includes a work station that houses the entire apparatus. The work station has a workbench, which may be provided with a chemically tolerant countertop, located beneath the suspended mixing vessels and upon which other collection containers can be placed for catching materials drained from the mixing vessels. Cabinets underneath the workbench may be used for storage of laboratory implements or other items. Along one side of the work station is a cabinet that encloses the motor and drive assembly and upon whose face is located controls for setting the motor speed and automatically controlling the mixing time.

Use of the work station allows performance of an entire, multiple stage extraction process without the time consuming and labor intensive steps of removing vessels from an agitator to add to or remove the vessels' contents. Thus, after adding sample and reagents to the vessels, they are rotated for an appropriate amount of time. Leaving the vessels within the holding tray, containers may be positioned directly underneath the vessels to catch the bottom layer that is extracted. Unlatching and swinging upwards the cover allows additional reagents to be added. The mixing and the extraction process may then be repeated. Such a multi-stage extraction process greatly increases the extraction recovery rate as well as accuracy and precision of the results, while decreasing the associated labor costs.

It is therefore an object of the present invention to provide an economical, easy-to-use automatic mixing apparatus capable of mixing the contents of numerous vessels.

It is another object of the present invention to provide a method of venting pressures built-up within the mixing vessels while preventing the escape of sample materials.

It is yet another object of the present invention to provide a mixing apparatus that rotates one or more mixing vessels at various speeds and for predetermined time periods or number of revolutions.

It is a further object of the present invention to provide a work station to house the entire mixing apparatus.

It is an additional object of the present invention to complete a multi-stage extraction procedure so that the vessels need not be removed until the extraction procedure is completed.

Other objects, features and advantages of the present invention will become apparent with reference to the remainder of the text and the drawings of this application.

DETAILED DESCRIPTION

Figure 1:
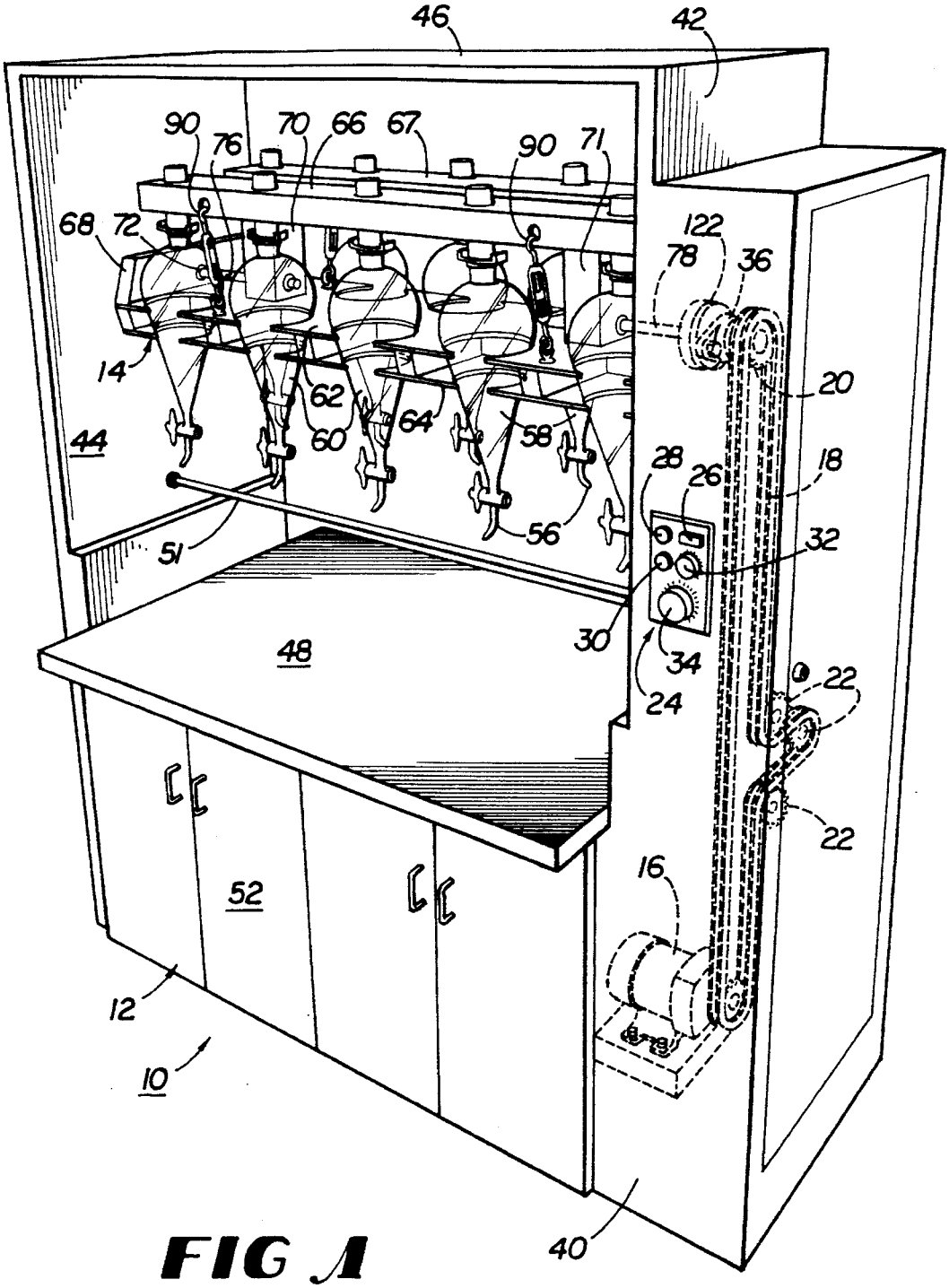
FIG. 1 is a perspective view of the present invention, showing a plurality of separatory funnels held within the housing and prepared for mixing.

FIG. 1 illustrates the mixing apparatus 10 of the present invention comprised of tray 14 and motor 16 enclosed within work station 12. Work station 12 may be formed of treated wood or laminate, sheet metal or any other suitable material. A cabinet 40 encloses motor 16, chain 18, sprocket 20 and tensioning sprockets 22. The back of cabinet 40 consists of a panel 42 that supports drive shaft 78 and is joined by crosspiece 46 to corresponding panel 44 that supports axis 76. Crosspiece 46 also may be comprised of single or multiple rails so that air flows through to a ventilation system, such as a ventilating hood (not shown). A workbench top 48, which may be chemically resistant, both connects panels 42 and 44 and provides work space that can hold, for instance, other collection vessels placed to catch the contents of the separatory funnels 60 that act as mixing vessels. Rod 50 is suspended between the bench top 48 and the stop-cocks 56 of separatory funnels 60 and is placed so that various laboratory implements can be attached thereto. Directly underneath workbench top 48 are storage cabinets 52 that may include shelving for storing laboratory or other equipment.

Each of separatory funnels 60 is comprised of a neck 59, a vessel portion 58 and a stop-cock 56. Tray 14 holds separatory funnels 60 suspended in upper shelf 62 and lower shelf 64, both of which have cutouts shaped to grasp the separatory funnels 60. One end of tray 14 is supported by axis 76 and the other end by drive shaft 78, although drive shaft 78 could extend across tray 14 to support both ends if desired. Axis 76 is secured by bearings 72 in panel 44 and supports the left end of tray 14 by piercing through partition 68 and column 70 to be secured by bearings 72. Retainer beam 66 connects columns 70 and 71, which not only support axis 76 and drive shaft 78, but also reduce the vibration caused upon rotating tray 14. Drive shaft 78 pierces and supports column 71, continues on through a partition (not illustrated) corresponding to left end partition 68, panel 42, commutator rings 22 and journal 46 eventually to end at sprocket 20. Chain 18 transmits the torque produced by motor 16 to sprocket 20. Tensioning sprockets 22 offer an adjustable means for tightening or loosening the chain 18. Alternatively, chain 18 and sprockets 20, 22 may be replaced by a belt and pulley respectively, which could also transmit the torque produced by motor 16 to drive shaft 18. As drive shaft 18 is turned, its torque is transmitted to tray 14, which rotates the separatory funnels 60, causing the contents within to mix thoroughly.

Control panel 24 controls motor 16 with power switch 26, on switch 28, off switch 30 and motor speed control 32. Although many sample and reagent mixtures are rotated at approximately twenty (20) revolutions per minute (rpm), other materials may require faster rotation. The motor speed control 32 allows the operator to vary the speed of the present invention for the particular chemicals being mixed. Additionally, timer 34 allows the operator to set the amount of time that the separatory funnels 60, which hold the samples and reagents to be mixed, will be agitated by rotation.

Figure 2:
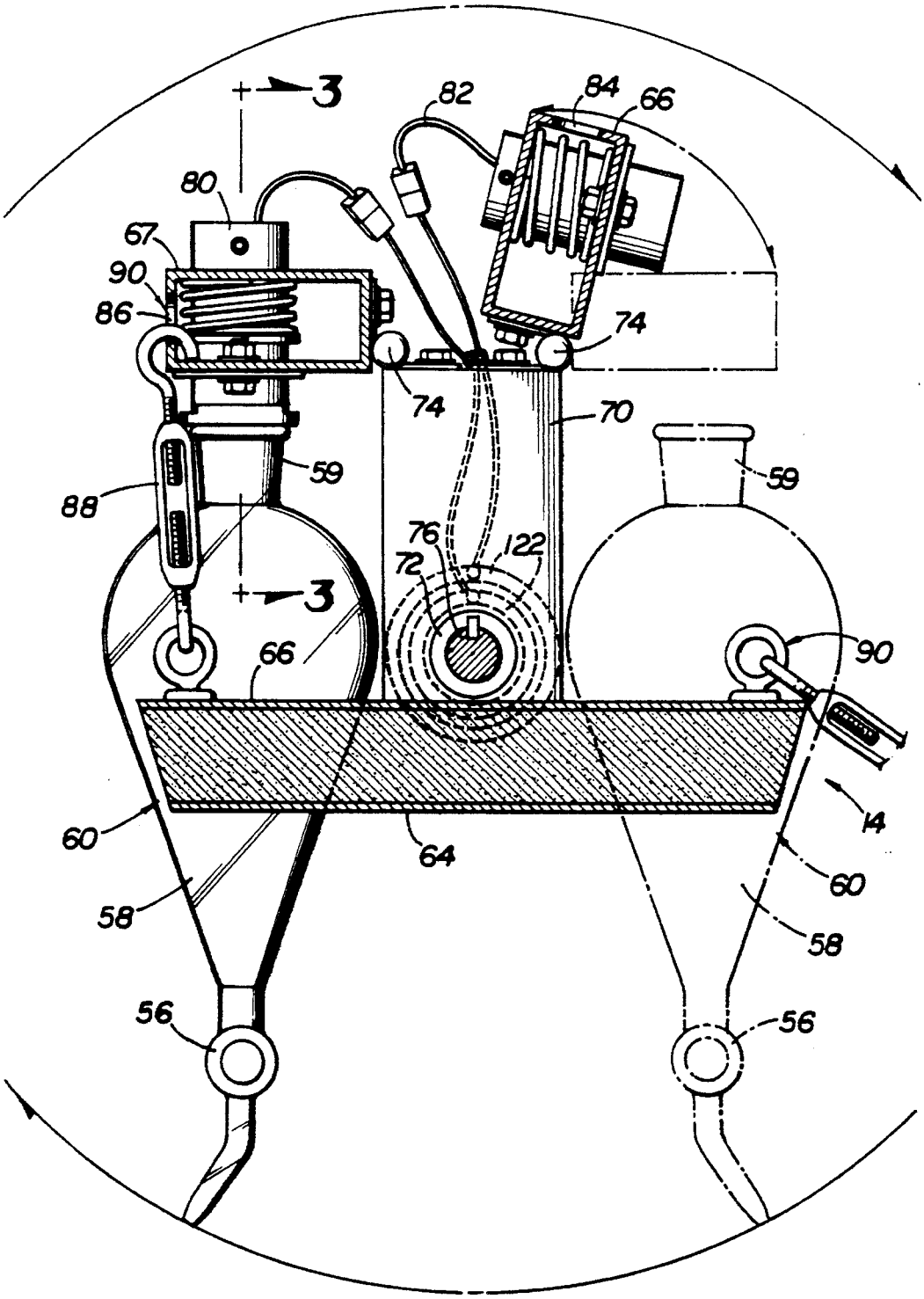
FIG. 2 is a cross-sectional side view of the apparatus for securing the separatory funnels prior to mixing.
Figure 4:
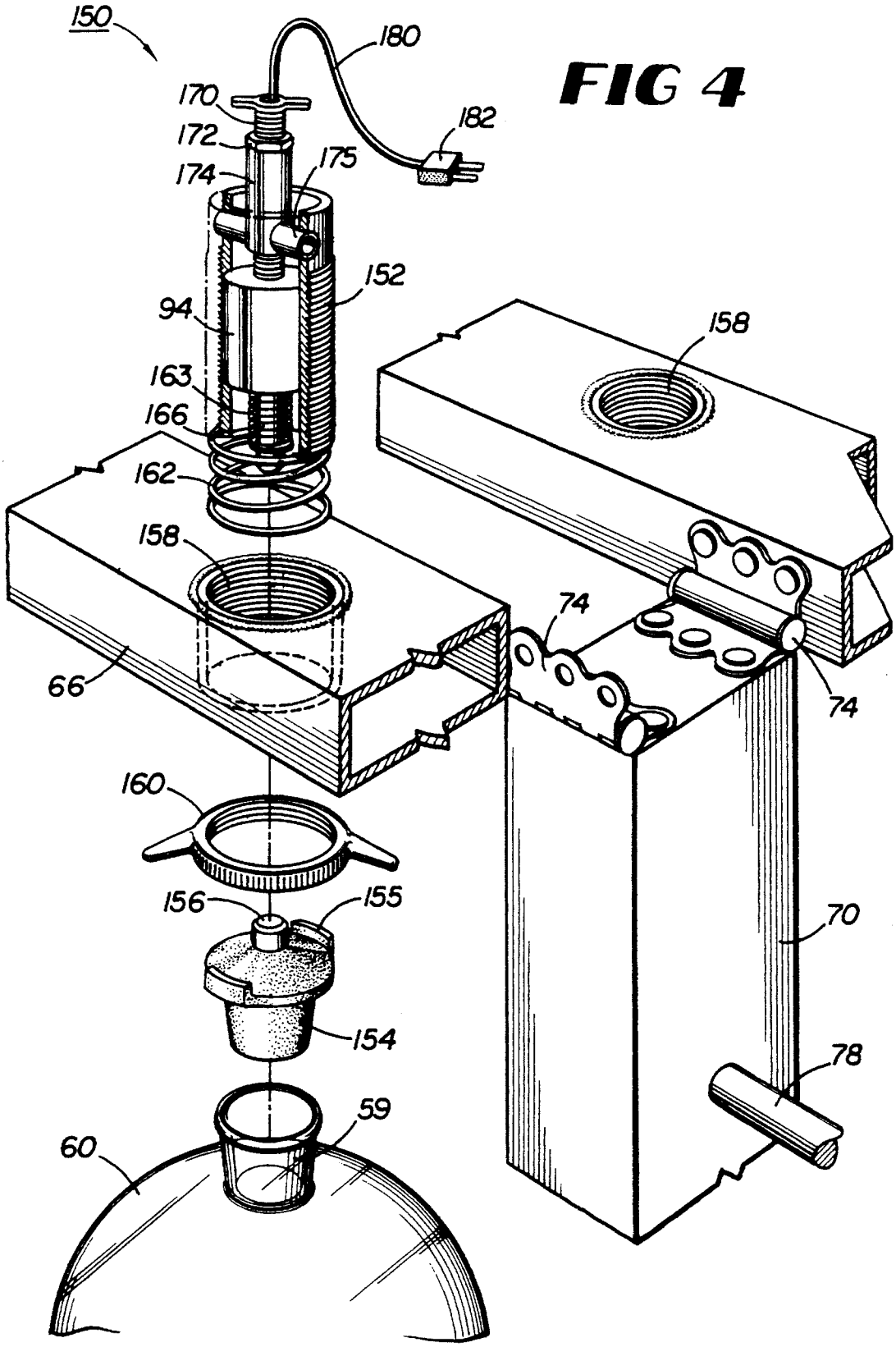
FIG. 4 is an exploded view of a second alternative solenoid and stopper retainer assembly that maintains a stopper in a separatory funnel and automatically vents pressure.

As illustrated in FIGS. 2 and 4, spring-loaded hinges 74 secure column 70 to hollow retainer beams 66 and 67. Spring-loaded hinges 74 are biased to force retainer beams 66 and 67 upward when the springs are at rest, as is shown for retainer beam 66 in FIG. 2. To load the tray 14 the hinged retainer beam 66 is released so that the spring-loaded hinges 74 force it upwards; a separatory funnel 60 is then maneuvered into the cutouts on upper shelf 62 and lower shelf 64. The separatory funnels 60 are accessible to the operator so long as retainer beam 66 remains unsecured because spring-loaded hinges 74 maintain it in an "up" position. Thus, additional reagents or sample materials can be added to the separatory funnels 60 while they are resting in a vertical, upright position, as in FIG. 2, without the necessity of removing them as each stage of mixing is completed. Moreover, because stop cocks 56 are in a downward orientation when tray 14 is at rest, the contents of separatory funnels 60 may easily be extracted off into other containers held on workbench top 48.

Once retainer beam 66 is swung downward against the force of spring-loaded hinges 74, it is secured by hooking one end of turnbuckle 88 through hole 92 in retainer beam 66. This action holds retainer beam 66 against the pressure of spring-loaded hinges 74 because the other end of turnbuckle 88 is held by eyelet 90 affixed to upper shelf 66. Four turnbuckles 88 are distributed near each corner of tray 14 to capture separatory funnels 60 between tray 14 and retainer beam 60 so that separatory funnels 60 do not shift during rotation. Of course, should axis 78 be extended across the full width of the tray 14, multiple columns could be provided, each with a spring-loaded hinge 74 securing columns to retainer beams 66 and 67, which could be segmented to allow individual access to each separatory funnel 60.

Figure 3:
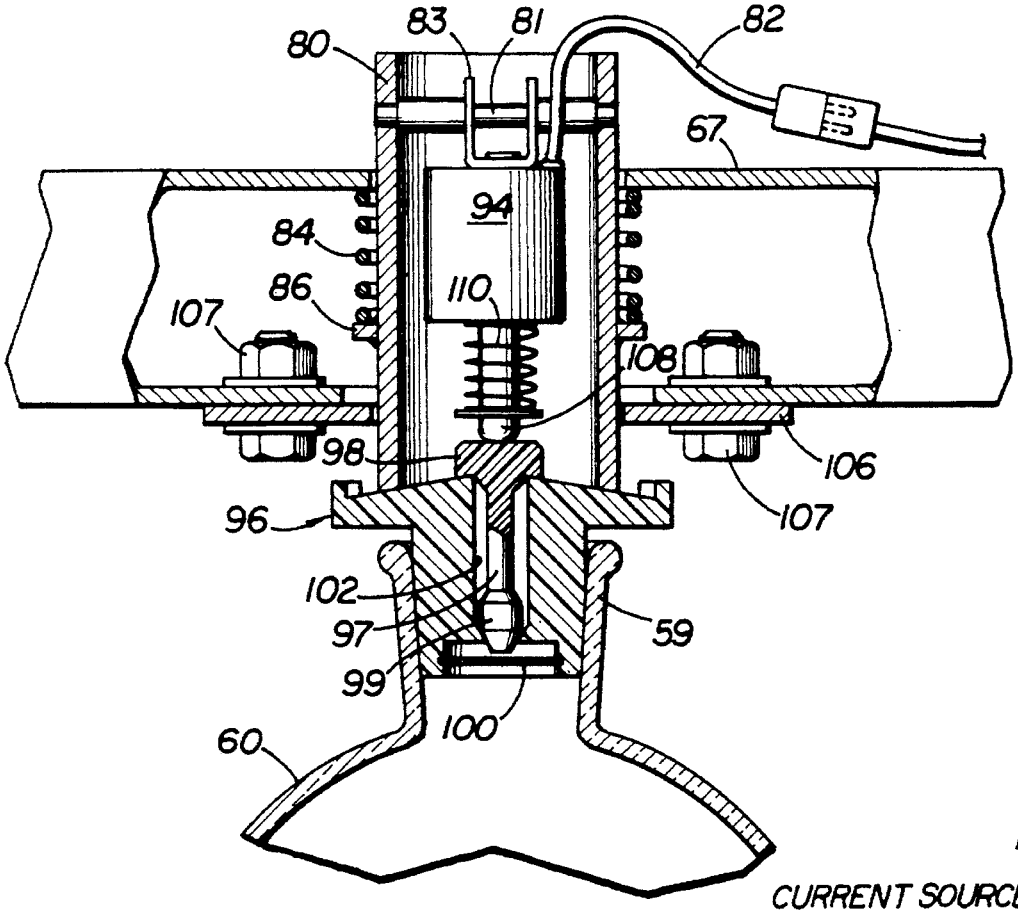
FIG. 3 is a cutaway view taken along line 3—3 of FIG. 2, showing a cross-sectional view of the solenoid and stopper inserted into one neck of a separatory funnel.

Solenoid 94 (see FIG. 3) connects to bracket 83 and is suspended in tube assembly 80 by pin 81, which has sleeves that abut against the legs of bracket 83 to fix it firmly. Tube assembly 80 floats within hollow retainer beam 66 and is prevented from dropping out by contact of welded flanges 86 with plate 106, which is secured to retainer beam 66 by nuts and bolts 107. The end of tube assembly 80 holds in place stopper 96 that may be inserted into the neck 59 of a separatory funnel 60. Spring 84, which in some embodiments provides eight pounds of force, exerts pressure against welded flange 86 on tube assembly 80 to bias it downwards, thereby maintaining stopper 96 within the neck of separatory funnel 60. Likewise, as the contents of separatory funnels 60 are mixed, the force of spring 84 (as well as the cooperation of retainer beams 66 and 67 with tray 14 to capture between them separatory funnels 60 and stoppers 96) maintains the stopper 96 within the neck 59. An additional advantage of the individually spring-loaded tube assemblies 80 is that they allow different models of separatory funnels 60 to be used in the same batch processing run since the "floating" nature of the tube assemblies 80 will accommodate separatory funnels 60, or other types of mixing vessels, of various heights.

Spring 84 is sufficient to hold the stopper 96 in place despite pressure build-up from any chemical reactions occurring within separatory funnel 60 because a pressure venting valve 97 is provided. Solenoid plunger 108 normally fixes valve 97, thus keeping tight first seal 98 and second seal 99 and preventing materials from escaping venting bore 102. Directly below second seal 99 lies a screen 100 that filters solid particulate matter which otherwise may clog bore 102. Solenoid 94 actuates plunger 108 when separatory funnel 60 is in a generally upright position because only then will commutator rings 122 transfer alternating current to solenoids 94. Once actuated, solenoid 94 moves solenoid plunger 108 away from contact with valve 97 and against the force of the spring 110, which in some embodiments provides three and three quarter (3.75) pounds of force, that otherwise fixes solenoid plunger 108 in place. Upon withdrawal of solenoid plunger 108 from contact with valve 97, only the weight of the valve core keeps first and second seals 98 and 99 tight. If the pressure within the separatory funnel is sufficient, valve 97 may move upwards to open first seal 98 and second seal 99 and vent gases through bore 102 that eventually exit at the top of tube assembly 80. In short, dangerous or bothersome gases are vented away from laboratory workers, yet no sample materials escape the separatory funnels 60.

FIG. 4 illustrates a second alternative solenoid and stopper retaining assembly 150, which also has a solenoid 94, tube assembly 152, stopper 154 and pressure relief valve 156. However, within retainer beam 66 is secured a threaded tube 158 that receives threaded tube assembly 152. Turning tube assembly 152 adjusts its penetration depth and nut 160 fixes that depth. A spring 162 is inserted between the end of tube assembly 152 and stopper 154, with the edges of the spring 162 held by wings 155 of stopper 154. The pressure relief valve 164 in stopper 154 is forced down by spring 163 that biases the solenoid plunger 166 against valve 164. The spring 162 could be omitted and contact of tube assembly 152 against spring-retainer wings 155 would maintain the stopper 154 within separatory funnel 60. Additionally, solenoid 94 could be adjusted to provide more or less pressure against valve 155. This is accomplished through turning depth adjuster 170, one of whose ends is fixed to one side of solenoid 94 and the other of whose ends is threaded to be held by nut 172 on top of stem 174. Trunnion 175 holds stem 174 fixed so that turning depth adjustor 170 within nut 172 will move solenoid 94 within tube assembly 152. Solenoid 94 is connected to an ac or dc power source by wire 180, which extends through depth adjuster 170 to plug 182 that connects into the wiring harness 124.

Figure 5:
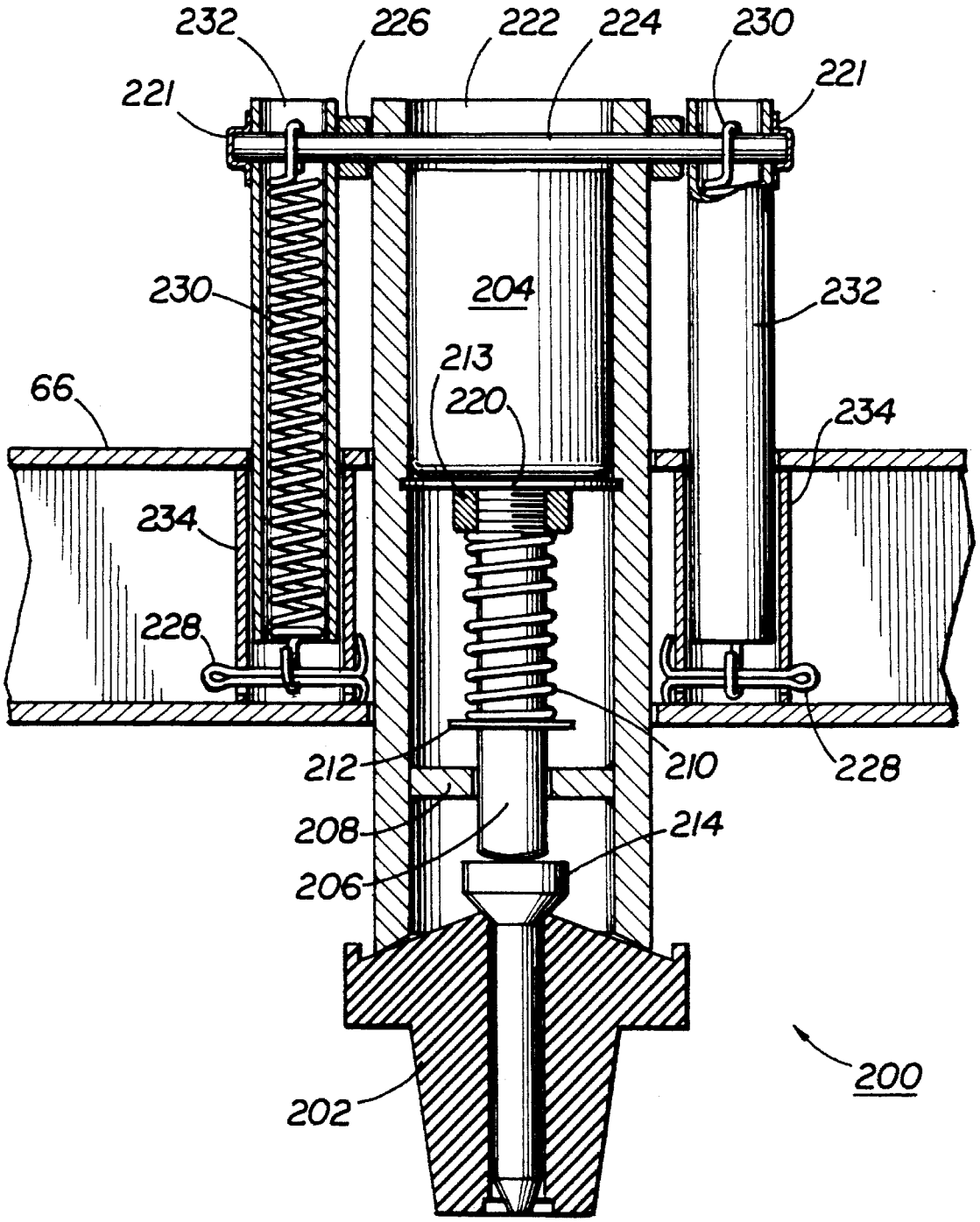
FIG. 5 is a cross-sectional view of a third alternative solenoid and stopper retainer assembly that maintains a stopper in a separatory funnel and automatically vents pressure.

Similarly, FIG. 5 illustrates a third alternative embodiment of a solenoid and stopper retaining assembly 200. Stopper 202 has valve stem 214 held in place by solenoid plunger 206 that can be withdrawn through stabilizing arms 208 by the ninety (90) ounce pull solenoid 204 may exert. Such withdrawal will be against the force of spring 210 that otherwise fixes solenoid plunger 206 in place by exerting force against clip 212, which is fixed to solenoid plunger 206, and base 213 of solenoid 204. Bar 220, quarter-inch rod 224 and tube assembly 222 traps solenoid 204 to prevent movement as solenoid plunger 206 is activated or the entire assembly rotated. Additionally, tube assembly 222, spacers 226 and pipes 232 are held and pulled together for mutual stability by quarter-inch rod 224 secured at each end by cap 221. Tube assembly 222 and pipes 232 may be formed of a suitable plastic, such as polyolefin. Aluminum, stainless steel or other suitable material may be used to form tubes 234.

Tube assembly 222 floats within retainer beam 66 and holds stopper 202 in place when retainer beam 66 is latched in place as previously described. Spring 230 prevent pipes 232 from sliding out of tubes 234 when retainer beam 66 is swung downward, causing tube assembly 222 to contact with a separatory funnel 60 and be pushed upwards. The force exerted by spring 230 on quarter-inch rod 224 and pin 228 is sufficient to maintain stopper 202 within its separatory funnel 60, while allowing tube assembly 222 to float so as to adapt to different sized separatory funnels 60 or other vessels.

Figure 6:
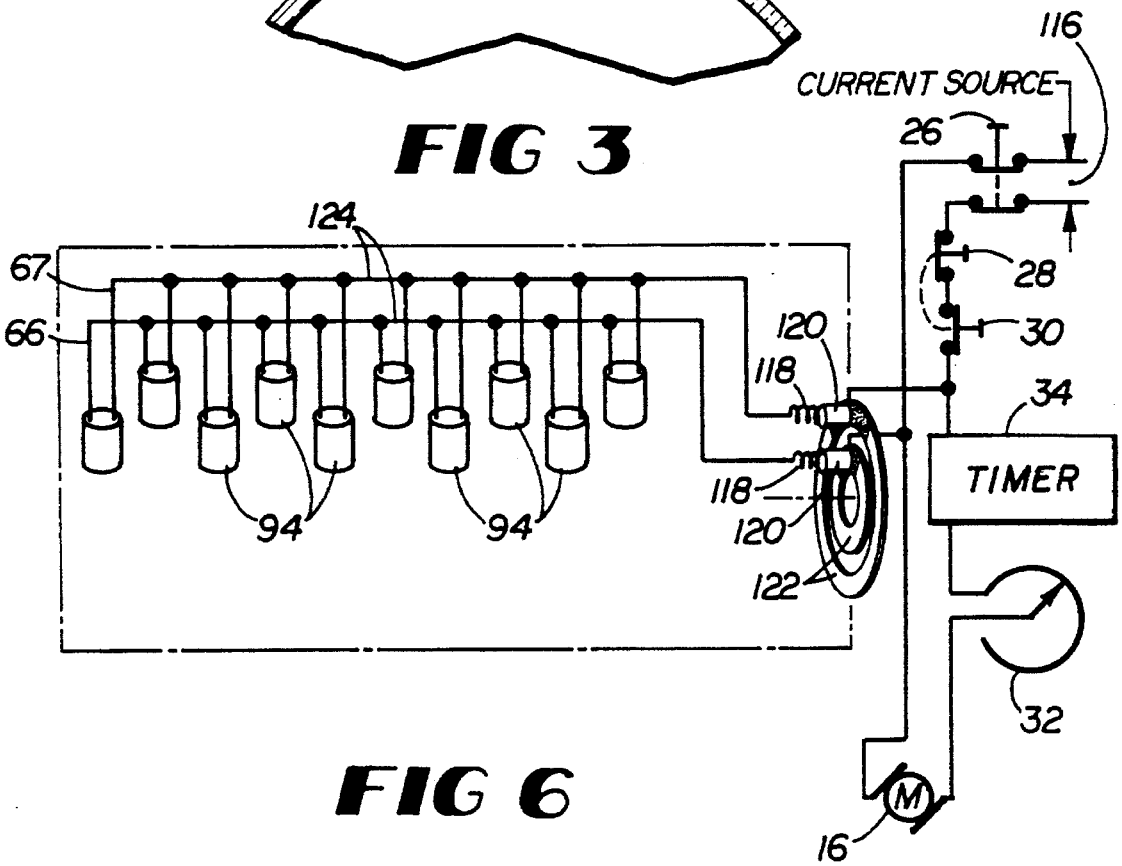
FIG. 6 is a schematic circuit diagram of the present invention.

The circuit schematic of FIG. 6 details the electrical operation of the present invention. Solenoids 94, which are suspended from retaining beams 66 and 67 in a row above tray 14, are wired in series to a harness 124 that connects with springs 118, which force brushes 120 into contact with commutator rings 122. Fixed commutator rings 122 have only limited conductive portions that conduct alternating current from source 116 only when separatory funnels 60 are in a generally upright orientation. Accordingly, gases vent upwards and there is no spilling of any sample materials through valve stem 97 in stopper 96.

The current source that supplies commutator rings 122 also energizes motor 16 and timer 34. When the set time is reached, timer 34 shuts off motor 16, whose speed is controlled by motor speed controller 32 that may be, for example, a variable resistance or a clutch for a geared motor. If the operator desires to rotate tray 14 for a certain number of revolutions, the setting of motor speed controller 32, which can be calibrated in revolutions per minute (rpm), can be multiplied by the number of minutes for which timer 34 is set to determine exactly the number of revolutions.

Alternatively, a direct current (dc), battery-powered solenoid could be combined with a magnetic switch placed on panel 42. The magnetic switch is set to sense when separatory funnels 60 reach an upright position and then close a circuit to a twelve volt battery. Slip rings connect the wiring harness 124 together with the battery, thereby energizing solenoids 94 when the circuit is closed. Either a magnetic switch to detect the position of tray 14 and close the circuit or a photoelectric sensor that detects reference marks on tray 14 as it rotates may be used to actuate the dc solenoids only when separatory funnels 60 are in a generally upright orientation. Thus, for instance, a switch can be set to provide current through a ten degree (10°) arc of rotation, centered about the vertical, upright position of separatory funnels 60. Such a setting allows for proper venting of the separatory funnels 60 while preventing inadvertent spilling of other materials.

The foregoing is provided for purposes of illustrating, explaining and describing one embodiment of the present invention. Modifications and adaptations to these embodiments will be apparent to those of ordinary skill in the art and may be made without departing from the scope or spirit of the invention and the following claims.

What is claimed is:

1. Apparatus for rotating a plurality of vessels to mix materials within the vessels, comprising (a) means for holding the vessels;

(b) means for rotating the holding means to agitate the materials, including (1) a drive shaft connecting to the holding means;

(2) means for rotating the drive shaft; and (3) means for controlling the speed of the drive shaft;

(c) means for controlling the number of rotations made by the holding means;

(d) means for releasing pressure within the vessels; and (e) a tube assembly for adjustably holding the pressure releasing means.

2. The apparatus of claim 1 in which each vessel defines an end and the holding means comprises a tray shaped to grasp the vessels and a cover that engages the end of each vessel.

3. Apparatus for rotating a plurality of vessels to mix materials within the vessels, comprising (a) means for holding the vessels;

(b) means for rotating the holding means to agitate the materials, including (1) a drive shaft connecting to the holding means;

(2) means for rotating the drive shaft; and (3) means for controlling the speed of the drive shaft;

(c) means for controlling the number of rotations made by the holding means; and (d) means for releasing pressure within the vessels, including (i) a stopper with a valve; and (ii) a solenoid that allows the valve to release pressure only when the holding means reaches a predetermined position.

4. Apparatus for mixing materials within at least one vessel comprising (a) means for holding the vessel;

(b) means for rotating the holding means;

(c) means for releasing pressure within the vessel so that no solid or liquid material escapes the vessel; and (d) a work station, comprising storage space and a bench directly underneath the holding means, for housing the holding means, rotating means, and pressure releasing means so that a multi-stage extraction process can be performed without removing the vessel from the holding means.

5. The apparatus of claim 4 in which the pressure releasing means includes a valve.

6. The apparatus of claim 4 in which the rotating means includes a motor connecting to a chain and a drive shaft connected to the chain and the holding means.

7. The apparatus of claim 4 further comprising means for automatically controlling the time during which the holding means is rotated.

8. The apparatus of claim 4 further comprising means for predetermining the number of revolutions that the holding means will make.

9. Apparatus for mixing materials within at least one vessel comprising (a) means for holding the vessel;

(b) means for rotating the holding means; and (c) means for releasing pressure within the vessel so that no solid or liquid material escapes the vessel, the pressure releasing means comprising:

(i) a valve; and (ii) a solenoid that prevents the valve from releasing unless the vessel is oriented so that no materials are spilled.

10. Apparatus for mixing the contents of a plurality of vessels each having an open end, comprising (a) a tray for holding the vessels;

(b) a cover that engages the open ends of the vessels and prevents the vessels from moving within the tray;

(c) a pressure releasing valve interposed between the cover and the open ends of the vessels and that operates only when the tray is in a predetermined position;

(d) a motor; and (e) a shaft connecting to the tray and a motor, which drives the shaft to rotate the tray.

11. The apparatus of claim 10 further comprising a work station that houses the mixing apparatus.

12. The apparatus of claim 10 in which a chain connects the shaft and the motor.

13. Apparatus for maintaining an optimum pressure within a vessel defining an end, comprising (a) a means for obstructing the end comprising a stopper with a valve; and (b) a solenoid that controls the obstructing means so that materials are trapped within or released from the vessel depending on the actuation of the solenoid.

14. The apparatus of claim 13 in which the solenoid may be actuated to move from a first position that prevents the valve from opening so that material is maintained within the vessel, to a second position that allows the valve to open so that material may pass into or out of the vessel.

15. The apparatus of claim 13 further comprising a control means for controlling the actuation of the solenoid.

16. A work station for performing a multi-stage extraction process upon the contents of a plurality of vessels each defining an open end, comprising (a) a tray for holding the vessels suspended within the work station;

(b) a cover that engages the open ends of the vessels so that the vessels are trapped between the tray and the cover and thereby prevented from moving within the tray;

(c) an assembly attached to the cover, the assembly including (1) a stopper with a pressure releasing valve disposed between the vessel ends and the cover; and (2) a solenoid that holds the pressure releasing valve closed until the vessels are in a substantially upright position, whereupon the solenoid actuates to allow the pressure releasing valve to open if the pressure within the vessel is sufficient;

(d) means for revolving the tray, comprising (1) a motor connecting to a chain; and (2) a shaft connecting to the chain and the tray so that the torque produced by the motor is transmitted by the chain to the shaft and tray, which is thereby revolved;

(e) a timer that deactivates the motor when the tray has been rotated for a predetermined amount of time; and (f) a bench for positioning containers beneath the tray so that a multi-stage extraction process can be performed without removing the vessels from the tray.

17. A work station for mixing materials within a vessel that defines at least one open end, the work station comprising (a) means for holding the vessel suspended within the work station;

(b) a pressure releasing valve for inserting over the open end of the vessel;

(c) means for moving the holding means in order to agitate the materials within the vessel;

(d) means, associated with the valve, for automatically allowing pressure to release when the vessel reaches a predetermined position; and (e) a bench located proximate to the holding means.

18. A work station for mixing materials within a vessel that defines at least one open end, the work station comprising (a) means for holding the vessel suspended within the work station;

(b) a pressure releasing valve for inserting over the open end of the vessel, wherein the valve is part of a cover and the holding means further comprises means for generating a preselected bias to force the cover against the open end of the vessel;

(c) means for moving the holding means in order to agitate the materials within the vessel; and (d) a bench located proximate to the holding means.

19. A work station according to claim 18 further comprising storage space located underneath the bench.

* * * * *